United States Patent [19]

Stefano et al.

[11] 3,964,358

[45] June 22, 1976

[54] PUNCHING APPARATUS WITH MECHANICALLY MOVABLE TOOL SUPPORT ARM

[75] Inventors: Rocco L. Stefano, East Amherest; Robert J. Galland, Cheektowago, both of N.Y.

[73] Assignee: Unipunch Products, Inc., Buffalo, N.Y.

[22] Filed: May 7, 1975

[21] Appl. No.: 575,376

[52] U.S. Cl. ..... 83/400; 83/564; 83/628; 83/698; 83/701

[51] Int. Cl.[2] ..... B26D 7/26

[58] Field of Search ..... 83/400, 698, 701, 563, 83/564, 628; 29/568

[56] References Cited

UNITED STATES PATENTS

| | | | |
|---|---|---|---|
| 3,270,605 | 9/1966 | Schott et al. | 83/522 |
| 3,405,581 | 10/1968 | Krynytzky | 83/563 |
| 3,765,291 | 10/1973 | Steufeldt | 83/563 |

*Primary Examiner*—Frank T. Yost
*Attorney, Agent, or Firm*—Stanley J. Price, Jr.; John M. Adams

[57] ABSTRACT

A punching apparatus includes a press frame having upper and lower portions forming a recess to receive a workpiece that is supported by a worktable mounted on the frame lower portion. A tool support arm having a tool holder releasably connected thereto is pivotally connected to the frame upper portion for movement into and out of vertical alignment with a ram punch and die. A fluid actuated piston cylinder assembly is connected to the press frame in the recess with an extensible rod of the assembly connected to the rear end portion of the tool support arm. Actuation of the assembly by an actuator valve laterally swings the tool support arm between a tool punching position and a tool changing position displaced from alignment with the ram punch and die. A fluid actuated extensible device in the frame upper portion secures the tool support arm to the press frame in the tool punching position. Operation of the actuator valve is coordinated with the extensible device by a control valve that is responsive to a pilot valve to pivot the tool support arm to the punching position and release the tool suppot arm from engagement to the press frame. A time delay device permits release of the tool support arm before the piston cylinder assembly is actuated to pivot the tool support arm. The control valve is actuated by the pilot valve to redirect flow to the extensible device and release the tool support arm from engagement to the press frame during the delay interval.

12 Claims, 8 Drawing Figures

12
14
10
52
40
44
80
84
90
86
74
42
18
82
70
48
36
46
46
76
78
32
28
26
134
34
170
30
16
24
22
20

PUNCHING APPARATUS WITH MECHANICALLY MOVABLE TOOL SUPPORT ARM

BACKGROUND OF THE INVENTION

1. Field of the Invention

This invention relates to a punching apparatus having a tool support arm pivotally connected to the punching apparatus for moving a tool holder with a punching tool retained therein between a tool punching position and a tool changing position and more particularly to a punching apparatus having a valve controlled actuator mechanism that swings the tool support arm and attached tool holder between the tool punching position and the tool changing position where the swinging movement of the tool support arm is coordinated with the engagement of the tool support arm to the press frame of the punching apparatus.

2. Description of the Prior Art

Conventional machines for perforating sheet metal include a worktable supported by the lower portion of a press frame with a ram punch positioned vertically above the worktable in the upper portion of the press frame. A suitable punching tool is positioned below the ram punch above the workpiece. Vertical movement of the ram punch moves the punching tool into and out of engagement with a die that is rigidly supported on the worktable. A tool support for positioning the punching tool in vertical alignment with the die is secured to the press frame above the worktable. In this manner, perforations of various shapes and sizes are made in the workpiece.

U.S. Pat. No. 3,270,605 discloses a clamping device by which the tool holder locks the punching tool in coordinated relation with the die. By manually releasing the clamp, the punching tool may be removed from the tool support. With this arrangement, the machine operator is required to use both hands in releasing the tool support from the frame or the punching tool from the tool holder. The steps of releasing the tool holder from the press frame and moving the tool support from coordinated relation with the die must be manually and separately performed.

A tool support holder, illustrated and described in U.S. Pat. No. 3,405,581, is releasably locked to a carriage and is movable with a carriage between an extended and retracted position. The carriage travels horizontally on rails positioned parallel to the upper portion of the press frame. With this arrangement, the carriage with the tool support holder is manually moved on the rails in a front-to-rear direction relative to the press frame for moving the tool support holder into and out of punching position. U.S. Pat. No. 3,745,646 discloses a tool changer for a multiple-hole turret press in which a punch and die of a fixed size are loaded into a tool holder that is arranged to rotate about a vertical axis from a tool loading position to a tool punching position.

There is need for a punching apparatus that has a tool holder releasably connected to the front end portion of a tool support arm that is pivotally connected to the press frame of the punching apparatus and is mechanically moved between the tool punching position and the tool changing position. In this manner, tools may be replaced in the tool holder or the tool holder changed on the tool support arm rapidly and efficiently without requiring the operator to manually move the tool support arm. The pivotal movement of the tool support arm should be coordinated with engagement of the tool support arm to the press frame so that the swinging movement of the tool support arm is coordinated with release of the tool support arm from the press frame to move the tool holder into and out of punching relation with the die.

SUMMARY OF THE INVENTION

In accordance with the present invention, there is provided a punching apparatus for perforating a workpiece that includes a press frame with an upper portion and a lower portion forming a longitudinal recess therebetween for receiving a workpiece to be supported by the lower portion. A tool support arm having a front end portion and a rear end portion is pivotally connected at the rear end portion to the press frame upper portion. The tool support arm is connected to the press frame upper portion for pivotal movement about a vertical axis thereof. A tool holder is releasably secured to the tool support arm front end portion. An actuator mechanism is pivotally connected to the press frame upper portion and the tool holder rear end portion. The actuator mechanism is operable to laterally pivot the tool support arm about the vertical axis on the press frame upper portion between a tool punching position and a tool loading position to permit replacement of the tool holder and tools in the tool holder. A valve controls the actuator mechanism to laterally pivot the tool support arm between the tool punching position and the tool loading position. The valve is accessibly located on the lower portion of the press frame.

A fluid actuated extensible device is provided on the press frame upper portion above the tool support arm and is operable upon actuation to rigidly secure the tool support arm with the attached tool holder to the press frame upper portion. The extensible device includes a vertically movable pin that is arranged to move into and out of a bore provided in the rear end portion of the tool support arm. The pin is aligned with the bore when the swing arm is positioned in the tool punching position.

The operation of the extensible device is coordinated with operation of the actuator by the valve for the actuator so that the tool support arm is moved to the tool punching position before the valve actuates the extensible device to extend the pin and secure the tool support arm to the press frame upper portion. The valve is further operable to actuate the extensible device to release the pin from engagement to the tool support arm. This permits the actuator mechanism to pivot the tool support arm about its connection to the press frame upper portion to a position where tools are easily changed in the tool holder or tool holders on the tool support arm.

The valve includes a time delay valve that is operable to delay operation of the actuator mechanism to pivot the tool support arm from the tool punching position to the tool loading position until the extensible device releases the tool support arm from engagement with the press frame upper portion. The actuator valve is connected to a source of pressurized fluid from a source by a control valve. The control valve also selectively directs pressurized fluid to the extensible means. A pilot valve for operating the control valve connects the actuator mechanism with the control valve. Flow from the actuator mechanism to the pilot valve opens the pilot valve and the flow is transmitted to the control valve. In this manner, the control valve is actuated to direct pressurized fluid to the extensible device to energize the extensible device. The extensible device by the movable pin secures the tool support arm to the press frame upper portion in the tool punching position.

The pilot valve is further responsive to the operation of the valve for controlling the actuator mechanism. Actuation of the extensible device by the actuator valve to pivot the tool support arm to the tool changing position closes the pilot valve. Closing the pilot valve terminates the fluid flow from the pilot valve to the control valve. The control valve then redirects flow to the extensible device so that the pin is released from engagement with the bore of the tool support arm. In this manner, the tool support arm is released from engagement to the press frame upper portion before the actuator mechanism pivots the tool support arm. To assure that the tool support arm is removed from connection with the press frame upper portion before the tool support arm is moved, the time delay valve delays flow from the actuator valve to the actuator mechanism until the extensible device has operated to release the tool support arm.

The actuator mechanism includes a fluid actuated piston cylinder assembly having a cylinder that is pivotally connected to the press frame and includes an extensible piston rod pivotally connected to the rear end portion of the tool support arm. The actuator valve directs fluid between the piston end and the rod end of the cylinder to thereby extend and retract the rod. Extension and retraction of the rod laterally swings the tool support arm about its connection to the press frame upper portion between the tool punching position and the tool changing position. Moving a lever of the actuator valve redirects fluid flow through the time delay valve from the piston end to the rod end of the cylinder. The rod is retracted in the cylinder pivoting the tool support arm from beneath the press frame upper portion.

Accordingly, the principal object of the present invention is to provide a punching apparatus having a tool support arm that is pivotally connected to the press frame of the punching apparatus for moving a tool holder with a punching tool positioned therein between a tool punching position and a tool changing position by an actuator that is mechanically controlled.

A further object of the present invention is to provide a tool support arm for a punching apparatus that is moved into and out of tool punching position to facillitate the change of tool holders on the tool support arm and tools in the tool holder by a fluid actuated piston cylinder assembly that is controlled by a valve device which coordinates the swinging movement of the tool support arm with engagement of the tool support arm to the press frame of the punching apparatus.

Another object of the present invention is to provide a punching apparatus having a pivotal tool support arm for supporting a tool holder with a fluid actuated extensible device that secures the tool support arm to the press frame of the punching apparatus so that the tool holder is maintained in tool punching position.

Another object of the present invention is to provide a punching apparatus having a mechanically swingable tool support arm that is releasably engaged to the press frame by operation of a control valve that releases the tool support arm from engagement to the press frame before the tool support arm is actuated to swing relative thereto.

An additional object of the present invention is to provide a valve for controlling the pivotal movement of the tool support arm actuator mechanism so that the tool support arm is released from engagement to the press frame before the actuator pivots the tool support arm.

These and other objects of the present invention will be more completely described and disclosed in the following specification, the accompanying drawings and the appended claims.

DESCRIPTION OF THE PREFERRED EMBODIMENTS

Figure 1:
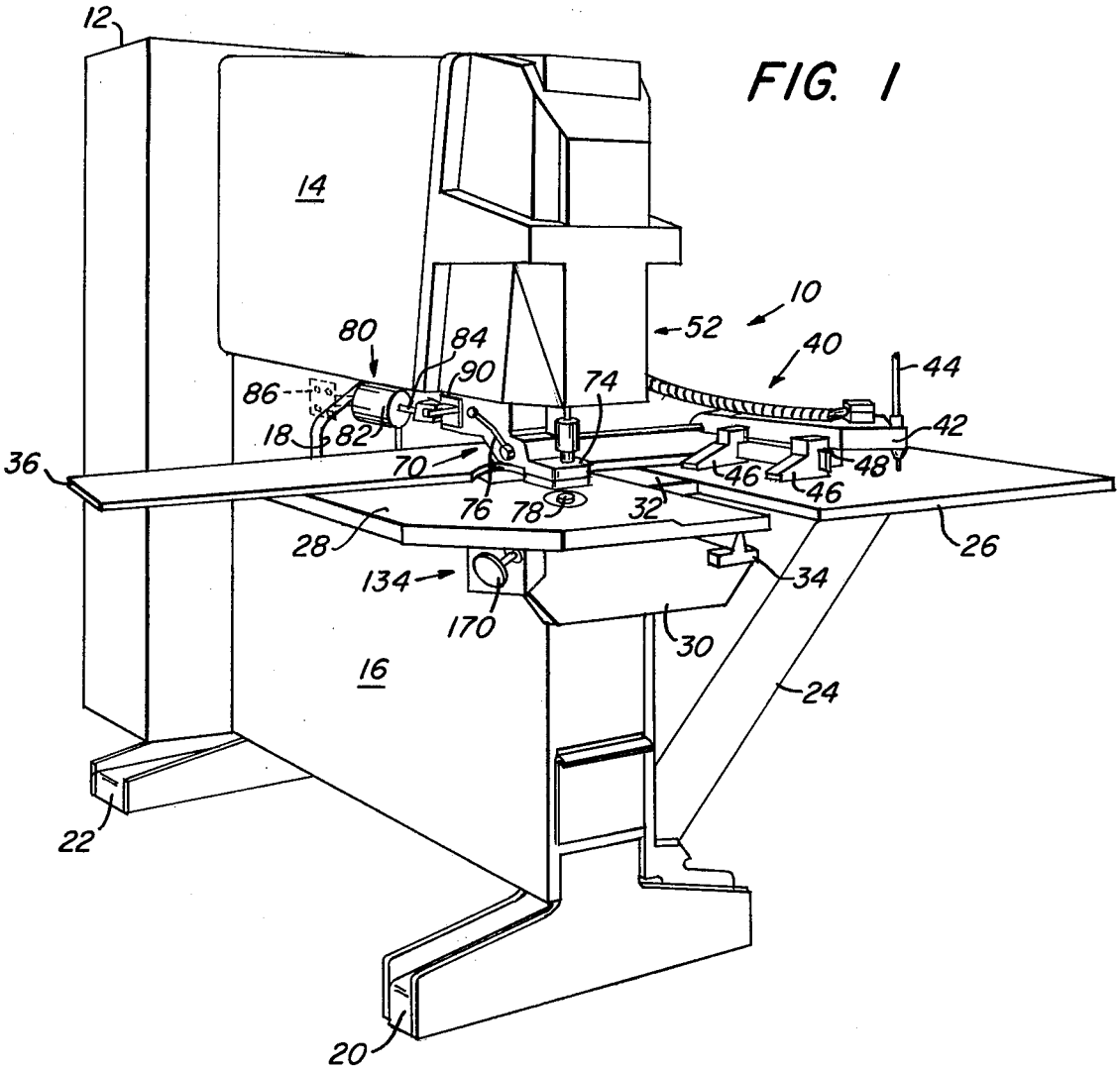
FIG. 1 is an isometric view of the punching apparatus, illustrating the piston cylinder actuator for moving the swing arm with attached tool holder between a punching position and a tool changing position.

Referring to the drawings and particularly to FIG. 1, there is illustrated a punching apparatus generally designated by the numeral 10 for perforating a workpiece according to a preselected pattern. The punching apparatus includes a press frame 12 having a C-shaped configuration that includes an upper arm portion 14 and a lower arm portion 16 which together from an elongated recess 18 for receiving the workpiece to be perforated. The press frame 12 is supported by legs 20 and 22 that are secured to the frame lower portion 16. A pair of upwardly extending table supports 24 are rigidly secured to the frame lower portion 16 and form a horizontal top surface upon which is positioned a table 26 for supporting a template used when the workpiece is to be perforated in accordance with the hole pattern of the template. A worktable 28 is horizontally supported by table support 30 that is bolted to the press frame lower portion 16 and extends into the recess 18. With this arrangement, the workpiece is supported within the recess 18 for perforating.

The table 26 is spaced from the table 28, and a carriage 32 is positioned therebetween for transverse movement on the upper surface of a support member 34. The support member 34 is secured to the table support 30. A longitudinal gage bar 36 is secured to the upper surface of carriage 32 and is movably supported on the upper surfaces of tables 26 and 28 by rollers (not shown). Accordingly, the transverse movement of the carriage 32 on the support member 34 moves the gage bar 36 transversely relative to the surface of tables 26 and 28.

A guide bar 38 is secured to the portion of the gage bar 36 that overlies the table 26. A duplicating mechanism generally designated by the numeral 40 for reproducing in the workpiece the pattern of a template is positioned on the table 26. The duplicating mechanism 40 includes an arm member 42 that is supported for longitudinal movement on the guide bar 38 of the gage bar 36. A stylus assembly 44 is supported in the arm member 42, and a plurality of clamping decices 46 for locking the workpiece to the duplicator arm 42 are secured to a flanged portion 48 that extends forwardly of the duplicator arm 42. With this arrangement, the workpiece may be selectively moved with the duplicator arm 42 above the template on the table 26. Thus, the duplicator arm 42 is arranged for longitudinal movement on the gage bar 36 which, in turn, is arranged for transverse movement with the carriage 32 on the support member 34. The workpiece, being secured to the duplicator arm 42 by the clamping devices 46, may be selectively moved longitudinally and transversely to any desired position above the table surface 26. By manually extending the probe of the stylus assembly 44 into the holes of the template and moving the stylus over the surface of the template the workpiece will be perforated in accordance with the hole pattern of the template.

Figure 2:
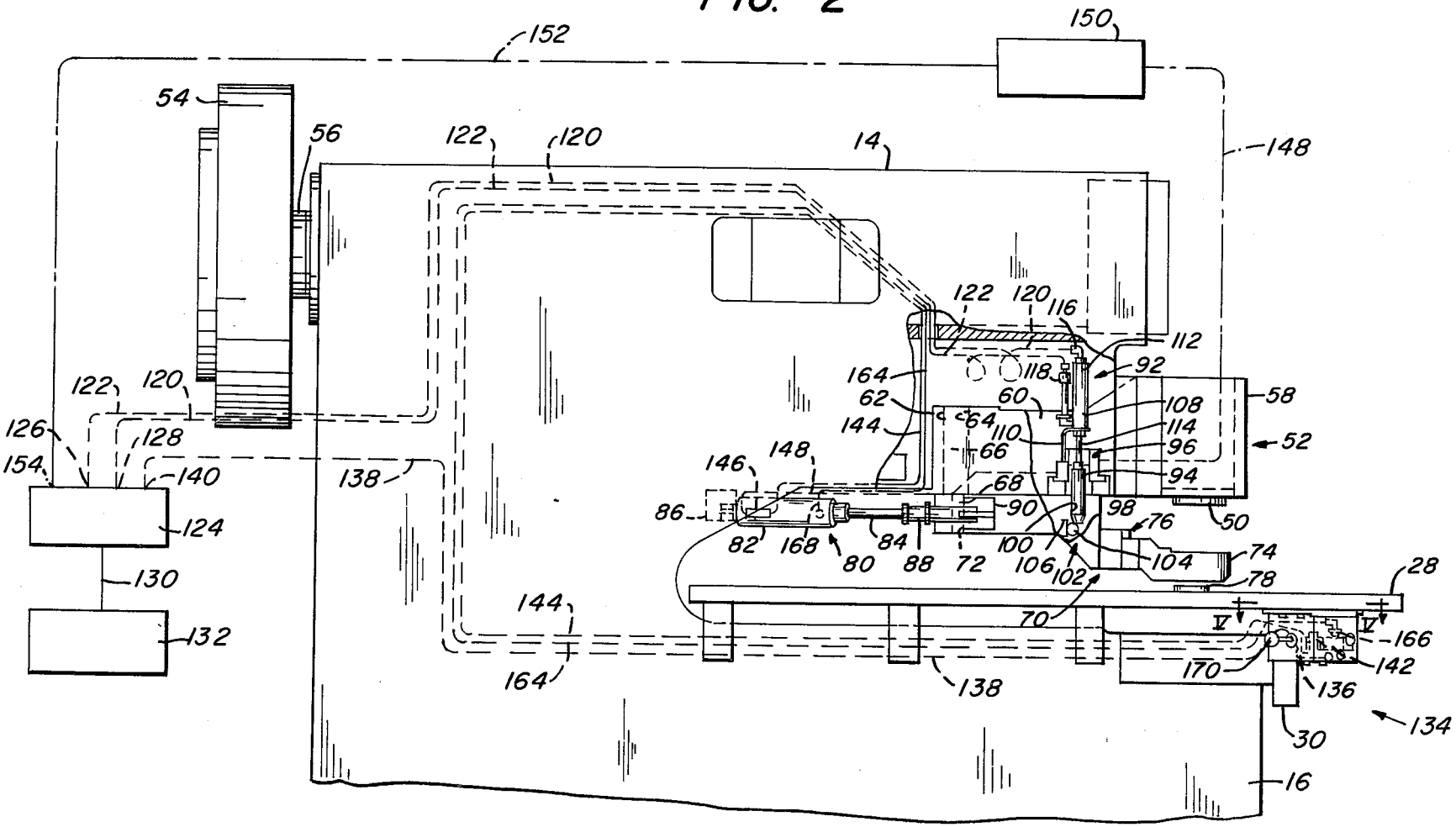
FIG. 2 is a schematic diagram of the pneumatic circuitry associated with the piston cylinder actuator for pivoting the swing arm and tool holder into and out of punching position.

The punching action is accomplished by a ram punch 50, illustrated in FIG. 2, that is supported for vertical reciprocal movement in a ram housing 52 that extends forwardly of the press upper portion 14 overlying the worktable 28. An electric motor (not shown) is mounted to the rear of the press frame 12 and is drivingly connected to a flywheel 54 that is nonrotatably secured to one end portion of a crankshaft 56. The crankshaft 56 is rotatably supported in the upper portion 14 of the press frame 12 and is connected by a suitable linkage mechanism at its other end portion to the ram punch 50. With this arrangement, the energy transmitted from the electric motor to the flywheel 54 produced rotation of the crankshaft 56 which is converted to rectilinear reciprocal motion for vertically moving the ram punch 50.

Figure 3:
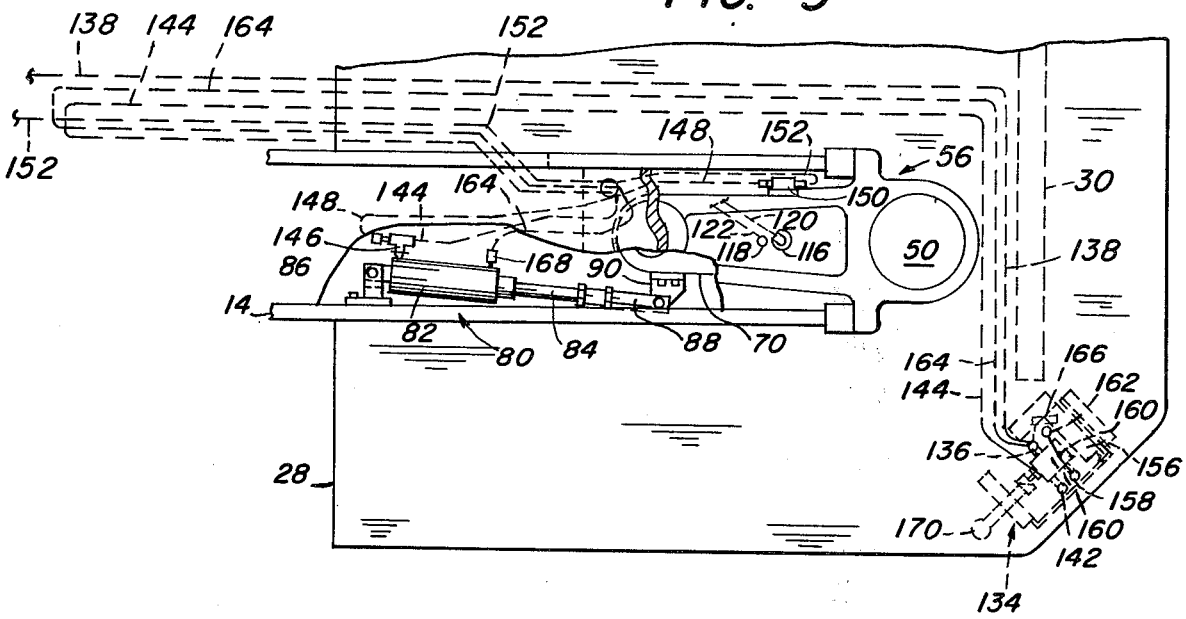
FIG. 3 is a fragmentary top plan view of the punching apparatus, schematicaly illustrating the piston rod extended from the actuator to position the swing arm in punching position.
Figure 4:
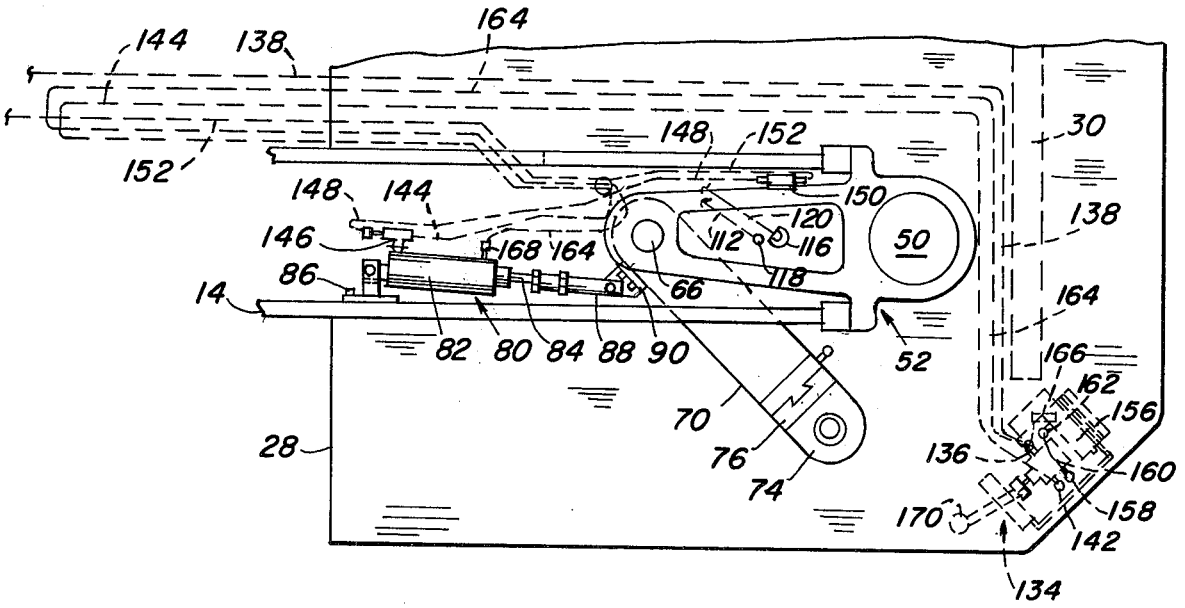
FIG. 4 is a schematic view similar to FIG. 3, illustrating the piston rod retracted within the actuator to position the swing arm in the tool changing position.

As illustrated in FIG. 2, the ram housing 52 has a front portion 58, an intermediate portion 60 and a rear portion 62. The ram housing rear portion 62 has a vertical bore 64 for rotatably supporting a shaft 66 having an end portion 68 of reduced diameter. The shaft end portion 68 extends below the ram housing 52. A swing arm generally designated by the numeral 70 for supporting a suitable punching tool is positioned below the ram housing and includes a vertical bore 72 in the rear portion thereof for nonrotatably receiving the lower end portion 68 of shaft 66. With the swing arm 70 secured to the shaft 66, the swing arm is arranged for lateral pivotal movement in a horizontal plane relative to the ram housing 52 between a tool punching position, as illustrated in FIGS. 1, 2 and 3 and a tool changing position, as illustrated in FIG. 4.

Referring to FIG. 2, the swing arm 70 supports at its forward end portion a tool holder 74 that is connected to the swing arm 70 by a locking device, generally designated by the numeral 76. The locking device 76 provides for quick and efficient changing of tool holders and punching tools therein on the swing arm 70. The details of the locking device 76 are illustrated and described in U.S. Pat. No. 3,107,562.

As illustrated in FIGS. 1 and 2, with the swing arm 70 positioned in tool punching position, the tool holder 74 attached to the swing arm 70, is vertically aligned with the vertical axis of the ram punch 50. The vertical axis of a punching die 78 that is positioned on the surface of table 28 and corresponds with the punching tool (not shown) is also aligned with the vertical axis of the ram punch 50. The die 78 is rigidly retained in the worktable 28 and supports the workpiece to be punched by the action of the ram punch 50 contacting the punching tool which, in turn, perforates the workpiece. With this arrangement, punching tool and die combinations of various shapes and sizes are easily and efficiently exchanged to provide a versatile punching apparatus capable of performing numerous operations such as punching, blanking, notching, nibbling and the like.

In accordance with the present invention, a piston cylinder actuator, generally designated by the numeral 80 in FIGS. 1–4, is operable to laterally swing the swing arm 70 with attached tool holder 74 between the tool punching position and the tool changing position. The actuator 80 includes a piston cylinder 82 having an extensible piston rod 84 therein. The cylinder 82 is pivotally connected by a bracket 86 to the press frame upper portion 14 within the recess 18. The cylinder 82 is operable upon actuation to extend and retract the rod 84 having a clevis end portion 88 that is pivotally connected to a bracket 90 that is secured to the side of the swing arm 70.

Extension of the piston rod 84 from the cylinder 82, in a manner explained hereinafter, pivots the swing arm 70 about its connection to the ram housing 52 to the tool punching position, as illustrated in FIGS. 1, 2 and 3. Accordingly, retraction of the piston rod 54 within the cylinder 82 urges the swing arm 70 to pivot laterally from the tool punching position to the tool changing position, as illustrated in FIG. 4. In the tool changing position, the swing arm 70 with attached tool holder 74 is displaced from vertical alignment with the ram housing 52 and the die 78 in the worktable 28. In the tool changing position the longitudinal axis of the swing arm 70 is preferably positioned at a 45° angle to the longitudinal axis of the ram housing 52, as illustrated in FIG. 4. In this position, the tool holder 74 is easily accessible to the machine operator for replacing a tool holder on the swing arm or a punching tool in the tool holder.

As illustrated in FIG. 2, the swing arm 70 with attached tool holder 74 is maintained in the tool punching position with the vertical axes of the ram punch 50, the tool holder 74 and the die 78 by a fluid actuated extensible device generally designated by the numeral 92. The extensible device 92 includes a pin 94 that is retained for vertical movement within a bore 96 of the ram housing intermediate portion 60 by a sleeve 98. A bore 100 is provided in the upper portion of the swing arm 70. When the swing arm 70 is positioned in the tool punching position the bore 100 is aligned with the bore 96 to receive the pin 94.

The end portion of the pin 94 when extended into the bore 100 of the swing arm 70 contacts a normally open electrical switch generally designated by the numeral 102 that completes an electric circuit for energizing the punching apparatus. The switch 102 includes a contact 104 that is connected to the end of a movable plunger 106 that is positioned within the swing arm 70. Thus, when the swing arm 70 is positioned in punching relation with the ram housing 52 and the die 78, the pin 94 engages the contact 104 to depress the plunger 106 inwardly to complete an electric circuit between the starter and the electric motor for driving the flywheel 54 and the crankshaft 56. Thus, by energizing a manually actuated foot switch (not shown) on the floow at the front of the press frame or by actuating the duplicating mechanism 40, the punching operation is commenced.

The pin 94 is moved into and out of the swing arm bore 100 by operation of the sxtensible device 92 which includes a piston cylinder assembly 108 that is supported in the ram housing 52 by a bracket 110. The pistion cylinder assembly 108 includes a fluid actuated cylinder 112 having an extensible piston rod 114 extending therefrom. The piston rod 114 is secured to the end of the pin 94. With this arrangement, extension and retraction of the piston rod 114 relative to the cylinder 112 moves the pin 94 into and out of the bore 100 in the swing arm 70.

The piston cylinder assembly 108 is fluid actuated and includes a first fluid inlet 116 communicating with the piston end of the assembly 108 and a second fluid inlet 118 communicating with the rod portion of the assembly 108. The fluid inlets 116 and 118 are connected by conduits 120 and 122 respectively to outlets 126 and 128 of a control valve 124. The control valve 124 is connected by conduit 130 to a source 132 of pressurized fluid, such as air. The control valve 124 is operable to selectively direct the flow of pressurized fluid from the source 132 through conduits 120 and 122 to the fluid inlets 116 and 118 of the assembly 108.

The control valve 124 directs the pressurized fluid received from the source 132 through outlet 126 to conduit 120 and the fluid inlet 116 of the piston cylinder assembly 108. Introducing fluid into the assembly 108 through inlet 116 extends the rod 114 to maintain the pin 94 in the bore 100 and engaging the contact 104 of switch 102. Accordingly, the pin 94 is retracted from the bore 100 and thus removed from contact with the switch 102 by the control valve 124 diverting the flow of pressurized fluid from the outlet 126 to the outlet 128 and into conduit 122. The fluid enters the inlet 118 of assembly 108 through the conduit 122. By directing fluid to the rod end of the assembly 108 in this manner, the piston rod 114 is retracted within the cylinder 112 removing the pin 94 from the bore 100 of swing arm 70. Removing the pin 94 from the bore 100 releases the swing arm 70 from rigid engagement with the ram housing 52 to permit the swing arm 70 to pivot about its connection to the ram housing 52. With the above described arrangement, the swing arm 70 and attached tool holder 74 are readily pivotal between the tool punching position and a location where easy access is provided to change either the tools in the tool holder or change tool holders on the swing arm.

A lever operated control valve 134 illustrated in FIGS. 2–5 controls the operation of the piston cylinder actuator 80 to laterally pivot the swing arm 70 and attached tool holder 74 between the tool punching position and the tool changing position. The valve 134 includes an inlet 136 that is connected to conduit 138 for receiving a continuous flow of pressurized fluid from outlet 140 of control valve 124. The fluid is directed from the valve 134 through outlet 142 into a conduit 144 that communicates with a branch connector 146 to the piston end of the actuator 80 displacing the pistoı in the cylinder 82 to thereby extend the rod 84 outwardly therefrom. Extension of the rod 84 pivots the swing arm 70 and the shaft 66 relative to the ram housing 52 from the tool changing position to the tool punching position, as illustrated in FIGS. 2 and 3.

Figure 2A:
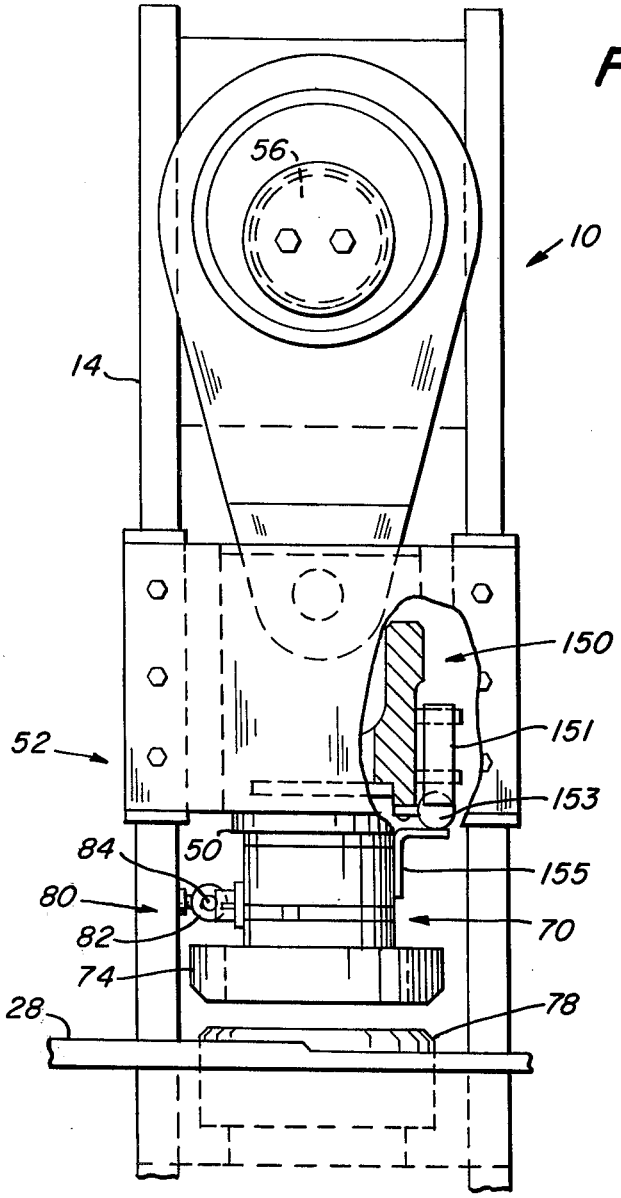
FIG. 2A is an enlarged fragmentary front view of the punching apparatus, illustrating the cam operated valve for actuating the swinging movement of the swing arm.

A portion of the fluid entering the cylinder 82 through the branch connector 146 is diverted therefrom by conduit 148 to a pilot valve 150, schematically illustrated in FIG. 2, that connects the actuator 80 to the control valve 124 by conduit 152. Conduit 152 is connected to inlet 154 of valve 124. As further illustrated in FIG. 2A, the valve 150 is mounted to the upper arm portion 14 and includes a vertically movable actuator 151 having a cam 153 secured thereto. The cam 153 rests upon a bracket 155 secured to the swing arm 70 to maintain the valve 150 in open position when the swing arm 70 is in the tool punching position. Flow through conduit 148 to the open pilot valve 150 permits the fluid flow through conduit 152 to control valve 124. In this manner, the control valve 124 is actuated to direct fluid flow from source 132 through outlet 126 and conduit 120 to the first fluid inlet 116 of the cylinder 112. Thus, the lever operated control valve 134 is operable to direct pressurized fluid to the actuator 80 for moving the swing arm 70 to the tool punching position and to actuate the extensible device 92 through the control valve 124 to secure the swing arm 70 and attached tool holder 74 to the ram housing 52 in the tool punching position.

Figure 5:
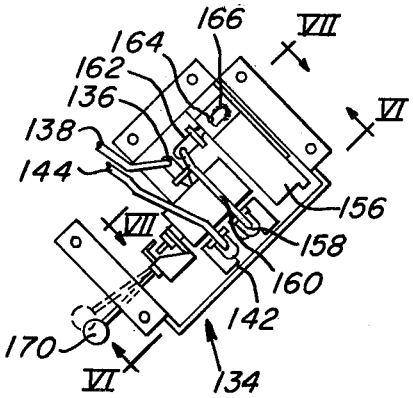
FIG. 5 is an enlarged top plan view of the lever operated control valve for controlling fluid flow to the piston cylinder taken along line V—V of FIG. 2, illustrating in phanton the lever position for moving the swing arm to the tool changing position.
Figure 6:
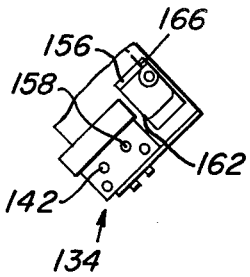
FIG. 6 is a side elevation of the lever operated control valve taken along the line VI—VI of FIG. 5.
Figure 7:
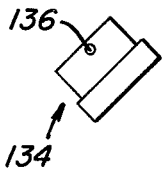
FIG. 7 is a side elevation of the lever operated control valve taken along the line VII—VII of FIG. 5.

The lever operated control valve 134 includes a time delay valve 156 illustrated in FIGS. 3 and 4 and in greater detail in FIG. 5. The time delay valve 156 is connected to valve outlet 158 by a by-pass conduit 160 connected to inlet 162 of the time delay 156. A conduit 164 connects outlet 166 of valve 156 to port 168 of the actuator cylinder 82. A lever 170 is selectively positioned on the valve 134 as illustrated in FIGS. 3 and 4, to direct fluid through conduit 144 to the piston end of the cylinder 82 or through the time delay valve 156 and the conduit 164 to the rod end of the cylinder 82.

With the lever 170 urged to a forward position on the control valve 134, as illustrated in FIG. 3, fluid is continuously supplied from the source 132 through the valve 134 and the conduit 144 to the actuator 80 to extend the rod 84 and pivot the swing arm 70 to the tool punching position. In the tool punching position, cam 153 abuts bracket 155 opening valve 150 and actuating the control valve 124 to direct flow of pressurized fluid through outlet 126 and conduit 120 to the extensible device 92. The pin 94 is then advanced into the bore 100 of the swing arm 70. The swing arm 70 is maintained in the tool punching position by the pin 94.

When it is desired to change the tool holder 74 on the swing arm 70 or replace the punching tool in the tool holder 74, the swing arm 70 is released from engagement to the ram housing 52 and swung laterally to the tool changing position. This is accomplished by moving the lever 170 to a rearward position on the valve 134, as illustrated in FIG. 4. Moving the lever 170 to a rearward position diverts fluid flow from the piston end of the actuator 80 to the rod end of the actuator 80. Diverting fluid to the rod end of the actuator 80 terminates the flow from the branch connector 146 through conduit 148 to the pilot valve 150. In this manner, flow through the valve 150 and conduit 152 to the control valve 124 is terminated.

Terminating flow from valve 150 to valve 124 actuates valve 124 to close outlet 126 and open outlet 128 for fluid flow from the source 132 to conduit 122. Fluid is directed from outlet 128 through conduit 122 to the second fluid inlet 118 of cylinder 112. The rod 114 is retracted within the cylinder 112 and the pin 94 is removed from the swing arm bore 100. In this manner, the swing arm 70 is released from engagement to the intermediate portion 60 of ram housing 52 for lateral pivoting movement. When the swing arm 70 is laterally pivoted the cam 153 moves from abutting contact with bracket 155 permitting the actuator 151 to move downwardly and thus close valve 150. The rod 114 remains retracted as long as the cam 153 is removed from contact with bracket 155. In this manner, electrical contact is broken between pin 94 and switch 102 to maintain a safe condition for exchanging the tool holder or tools therein and the corresponding die.

The time delay valve 156 provides for disengagement of the pin 94 from the swing arm 70 prior to retraction of the rod 84 in the actuator cylinder 82 and pivoting of the swing arm 70. The time delay valve 156 interrupts fluid flow from the valve 134 to the rod end of the actuator cylinder 82 for a time interval sufficient to permit the pin 94 to be removed from the bore 100 of the swing arm 70. As stated above, interrupting flow to the actuator branch connector 146 terminates flow through valve 150 and conduit 152 to the control valve 124. The control valve 124 is actuated to direct fluid flow to the extensible device 92 from the inlet 116 to the inlet 118 for retraction of the pin 94 from the swing arm 70. This is accomplished before the control valve 134 supplies fluid to the actuator 80 to retract the rod 84 and to pivot the swing arm 70 from the tool punching position to the tool changing position. With this arrangement, the pin 94 is fully retracted before the swing arm 70 is moved by the actuator 80. The time delay is preferably in the range between 2 or 3 seconds.

In a similar arrangement of pin 94 is not extended until the swing arm bore 100 is aligned with the bore 96 and the pilot valve 150 is opened by contact of the cam 153 with bracket 155 on the swing arm 70. Opening the valve 150 by the upward movement of the actuator 151 when the swing arm 70 is moved to the tool punching position supplies fluid through conduit 152 to the control valve 124. Fluid is then directed to inlet 116 of cylinder 112 to extend the rod 114 and pin 94. In the tool punching position, bore 96 is aligned with bore 100, and the pin 94 is inserted into bore 100 to lock the swing arm 70 in place. This also energizes the punch circuit by contact of the pin 94 with the switch 102.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than is specifically illustrated and described.

We claim:

1. A punching apparatus comprising, a press frame having an upper portion and a lower portion forming a longitudinal recess therebetween for receiving a workpiece supported by said lower portion, a tool support arm having a front end portion and a rear end portion, said rear end portion connected to said press frame upper portion for pivotal movement about a vertical axis thereon, a tool holder releasably secured to said tool support arm front end portion, actuator means for laterally pivoting said tool support arm about said vertical axis to said press frame upper portion between a tool punching position and a tool changing position to permit replacement of said tool holder and tools in said tool holder, said actuator means pivotally connected to said press frame upper portion and said tool support arm rear end portion, and valve means for controlling said actuator means to laterally pivot said tool support arm between said tool punching position and said tool changing position.

2. A punching apparatus as set forth in claim 1 which includes, fluid actuated extensible means for rigidly securing said tool support arm and said tool holder to said press frame upper portion when said tool support arm is in said tool punching position, said valve means operable to actuate said extensible means to secure said tool support arm and said tool holder to said press frame upper portion when said actuator means pivots said tool support arm to said tool punching position.

3. A punching apparatus as set forth in claim 2 which includes, said valve means operable to actuate said extensible means to release said tool support arm from engagement to said press frame upper portion to permit said actuator means to pivot said tool support arm to said tool changing position.

4. A punching apparatus as set forth in claim 2 in which said fluid actuated extensible means includes, a piston cylinder assembly supported on said press frame arm member, an extensible rod slidably positioned within said piston cylinder assembly, a pin member connected to the end portion of said rod for vertical movement therewith, and said tool support arm having a bore for receiving said pin member upon extension of said rod from said piston cylinder assembly when said tool support arm is positioned in said tool punching position to thereby rigidly secure said tool support arm to said press frame.

5. A punching apparatus as set forth in claim 4 which includes, said piston cylinder assembly operable upon actuation to retract said pin member to withdraw said pin member from said bore to release said tool support arm from engagement to said press frame and premit pivotal movement of said tool support arm relative to said press frame to said tool changing position.

6. A punching apparatus as set forth in claim 2 which includes, a source of pressurized fluid, valve control means for selectively directing fluid from said source to said extensible means and to said valve means to control said actuator means and the pivotal movement of said tool support arm, and pilot valve means for connecting said actuator means to said valve control means to supply fluid to actuate said valve control means to, in turn, actuate said extensible means and thereby secure said tool support arm to said press frame upper portion in said tool punching position.

7. A punching apparatus as set forth in claim 6 which includes, said pilot valve means being responsive to operation of said valve means for controlling said actuator means such that actuation of said actuator means to pivot said tool support arm to said tool punching position permits fluid flow through said pilot valve means to said control valve means to thereby actuate said extensible means to secure said tool support arm in said tool punching position.

8. A punching apparatus as set forth in claim 6 which includes, said pilot valve means being responsive to operation of said valve means for controlling said actuator means such that actuation of said actuator means to pivot said tool support arm to said tool changing position terminates fluid flow through said pilot valve means to said control valve means to thereby actuate said extensible means to release said tool support arm from said tool punching position.

9. A punching apparatus as set forth in claim 8 which includes, said valve means for controlling said actuator means being operable to delay actuation of said actuator means to pivot said tool support arm to said tool changing position until flow through said pilot valve means to said valve control means is terminated and said extensible means is energized by said valve control means to release said tool support arm from engagement to said press frame upper portion.

10. A punching apparatus as set forth in claim 1 which includes, means associated with said valve means for delaying operation of said actuator to pivot said tool support arm from said tool punching position to said tool changing position until said extensible means is actuated to release said tool support arm and said tool holder from engagement to said press frame upper portion.

11. A punching apparatus as set forth in claim 1 in which said actuator means includes, a fluid actuated piston cylinder assembly having an extensible piston rod positioned therein, said piston cylinder assembly pivotally connected to said press frame upper portion within said longitudinal recess, said piston rod having an end portion pivotally connected to said tool support arm rear end portion, and said piston cylinder assembly having means for receiving pressurized fluid from said valve means such that said valve means is operable to actuate said piston cylinder assembly and thereby extend and retract said piston rod to laterally swing said tool support arm between a tool punching position and a tool changing position.

12. A punching apparatus as set forth in claim 1 in which said valve means includes, a lever operated valve device having conduit means for connecting said actuator means to a source of pressurized fluid, said lever operated valve device operable in a first position to transmit pressurized fluid from said source to said actuator and thereby energize said actuator to pivot said tool support arm from said tool changing position to said tool punching position, and said lever operated valve device operable after a selected delay interval in a second position to transmit pressurized fluid from said source to said actuator and thereby energize said actuator to pivot said tool support from said tool punching position to said tool changing position.

* * * * *